US007600501B2

(12) United States Patent
Rantala

(10) Patent No.: US 7,600,501 B2
(45) Date of Patent: Oct. 13, 2009

(54) METHOD FOR INCREASING THE EFFECT TO BE PRODUCED IN A MOTOR, PUMP OR THE LIKE

(76) Inventor: Velkko Kalevi Rantala, Suvipellontie 20, Vastila (FI) FIN-49290

( * ) Notice: Subject to any disclaimer, the term of this patent is extended or adjusted under 35 U.S.C. 154(b) by 0 days.

(21) Appl. No.: 11/446,526

(22) Filed: Jun. 5, 2006

(65) Prior Publication Data

US 2007/0131197 A1 Jun. 14, 2007

Related U.S. Application Data

(63) Continuation of application No. 10/485,361, filed as application No. PCT/FI02/00646 on Jul. 25, 2002, now abandoned.

(30) Foreign Application Priority Data

Jul. 31, 2001 (FI) ..... 20011591

(51) Int. Cl.

| | |
|---|---|
| ***F02B 53/04*** | (2006.01) |
| ***F01C 1/00*** | (2006.01) |
| ***F01C 1/46*** | (2006.01) |
| ***F04C 18/00*** | (2006.01) |
| ***F04C 2/00*** | (2006.01) |

(52) U.S. Cl. ..... 123/237; 123/238; 418/248; 418/247; 418/83

(58) Field of Classification Search ..... 123/246, 123/237, 228, 18 R; 418/248, 247, 12, 83
See application file for complete search history.

(56) References Cited

U.S. PATENT DOCUMENTS

| | | | | |
|---|---|---|---|---|
| 220,520 A | | 10/1879 | Chapman | 418/248 |
| 1,012,237 A | * | 12/1911 | Bond | 418/248 |
| 1,019,177 A | | 3/1912 | Morton | 123/237 |
| 2,533,252 A | | 12/1950 | Hinckley | 418/248 |
| 2,908,225 A | | 10/1959 | Lehman | 418/247 |
| 3,081,707 A | | 3/1963 | Marshall | 418/248 |
| 3,545,888 A | | 12/1970 | Wycliffe et al. | 418/83 |
| 3,707,073 A | | 12/1972 | Bernstein | 123/18 R |
| 4,214,557 A | | 7/1980 | Beach, Jr. | 123/18 R |
| 4,286,555 A | | 9/1981 | Williams | 123/228 |
| 4,423,710 A | | 1/1984 | Williams | 123/228 |
| 4,487,167 A | | 12/1984 | Williams | 123/18 R |
| 4,658,779 A | | 4/1987 | del Granado | 123/237 |

FOREIGN PATENT DOCUMENTS

| | | | |
|---|---|---|---|
| CH | 657665 A5 | | 9/1986 |
| DE | 4103829 A1 | | 10/1992 |
| EP | 359837 A1 | | 3/1990 |
| GB | 275302 | | 7/1927 |
| GB | 2120323 A | | 11/1983 |
| JP | 11022621 A | * | 1/1999 |
| JP | 11022622 A | * | 1/1999 |
| JP | 11062807 A | * | 3/1999 |
| WO | WO00/45032 | | 8/2000 |

* cited by examiner

*Primary Examiner*—Thai Ba Trieu
(74) *Attorney, Agent, or Firm*—Jacobson Holman PLLC

(57) ABSTRACT

A method for increasing the power output in an engine, pump, or similar device, which includes a cylinder, inside which is a lever piston pivoted to make a reciprocating motion and a rotating piston mounted eccentrically in a bearing to make a rotating motion, as well as an inlet opening opening into the work chamber of the cylinder and an exhaust opening leading out of the exhaust chamber of the cylinder. At least the rotating piston is hollow or manufactured from a material lighter than the pressurized medium used in the device. The lever piston too can be hollow or manufactured from a material lighter than the medium used.

6 Claims, 2 Drawing Sheets

METHOD FOR INCREASING THE EFFECT TO BE PRODUCED IN A MOTOR, PUMP OR THE LIKE

This is a continuation application of Ser. No. 10/485,361 filed Mar. 22, 2004; now abandoned which in turn is a nationalization of PCT/FI02/00646 filed Jul. 25, 2002 in English.

FIELD OF THE INVENTION

The present invention relates to a method for increasing the power output in an engine, pump, or similar device. The invention particularly relates to a device, which exploits buoyancy, in addition to its other properties.

BACKGROUND OF THE INVENTION

Buoyancy is based on the well-known fact that when an object is submerged in a liquid it loses a part of its weight equal to the amount of liquid displaced. Attempts have been made to utilize buoyancy, for example, by using various devices based on pontoons, by exploiting the energy of waves or tides.

SUMMARY OF THE INVENTION

These inventions have had the drawbacks of low efficiency, large size, a complex mechanism, and the unsuitability of the devices for many purposes and, among other things, for utilizing gravity.

The invention is intended to eliminate these defects and create a device that utilizes buoyancy and the pressure of a medium.

According to the invention, this purpose can be achieved, if, for example, substantial alterations, which permit buoyancy to be utilized, are made to a device according to PCT/FI00/00034.

In general, an engine or similar according to the invention, like one applying the basic principles according to the aforesaid international application, is formed of a cylinder, which is manufactured from any material used for this purpose. The cylinder can have a generally flat shape seen along the plane of the paper in the figures. It can be assembled from two or more components forming layers, which are suitably attached to each other, for example, in the same way as the cylinder head is attached to the cylinder block in an internal combustion engine.

Other components in the solution used in the method according to the invention are naturally gaskets, various pipes connected to the inlet and exhaust ducts, valves, heaters for the medium, etc., as well as means used to handle the output of power from the engine.

The device for use according to the invention includes two cylinder bores for the work chambers. Shafts run through these work chambers run at right angles to the paper in the figures and are mounted in bearings, for example, so that the ends of the shafts above the paper are set in bearings in the 'head' of the engine while the ends of the shafts below the level of the paper go through the 'base' of the engine, where they are set in bearings. A rotating piston, which is eccentric, is mounted in bearings on one of the shafts. A lever device, a lever piston, is, in turn, mounted in bearings on the other shaft.

The internal construction of the engine or similar is as follows. The shafts run through the bores of the work chambers of the cylinder. The rotating piston is attached eccentrically to one shaft and the lever piston to the other, for example, as described above, but in any case eccentrically close to its outer edge, as the figures clearly show. Ample eccentricity is, in this case, an advantage, because it is precisely with its aid that power is obtained in the lever-piston engine.

The lever piston and the corresponding bore, which forms the second work chamber, is clearly larger than the rotating piston, which is essentially a cylindrical piece with a circular cross-section. The outer edge of the lever piston is particularly shaped as a segment of the circumference of a circle. Closer to the farthest end from the shaft, there is a machined recess, which is nearly the size of half of the rotating piston, as shown in the figure. In each revolution, the rotating piston rotates into the recess in the lever piston, at which stage the exhaust chamber has nearly entirely vanished and exhausted into the outlet duct.

The outlet duct can be lead, for example, to the inlet valve of a second lever-piston engine, which can also be a simple inlet duct without valves, so that there is no limit to the number of engine units that can be connected together in solutions according to the invention. The engine units can be connected to each other and simultaneously connected using the rotating piston shafts of each unit, in the same position, or at a desired angle to each other.

According to the invention, it has now been realized that, in the type of solution in question, the buoyancy arising from a component of a lighter material submerged in a liquid can also be exploited to produce energy.

The intention of the invention can also be realized with other corresponding devices that utilise pressure or gravity.

Thus, the rotating piston is manufactured to be hollow or from a material that is lighter than the medium. The device is turned in its entirety, for example, about 90 degrees clockwise, so that when the pressure effect of the medium ends, the rotating piston is at its lower dead centre while in the rest and exhaust stages of the device the buoyancy rotates the rotating piston again to its upper dead centre, where the pressure effect of the medium starts again.

The lever piston acts as a valve in the inlet opening and the rotating piston as a valve in the exhaust opening.

Another possibility is to manufacture the lever piston to be entirely or partly hollow, or of a material that is lighter than the medium and to turn the device to the best position in terms of the buoyancy.

BRIEF DESCRIPTION OF THE DRAWINGS

In the following, the invention is examined in greater detail with reference to the accompanying drawings, which are cross-sections showing the operating principle according to the invention and the general construction of the device. A description of the operation of the device according to the invention is provided by going through a complete revolution, from stage to stage according to FIGS. 1-4, proceeding in their numerical order.

DETAILED DESCRIPTION OF THE PREFERRED EMBODIMENTS

FIG. 1

Figure 1:
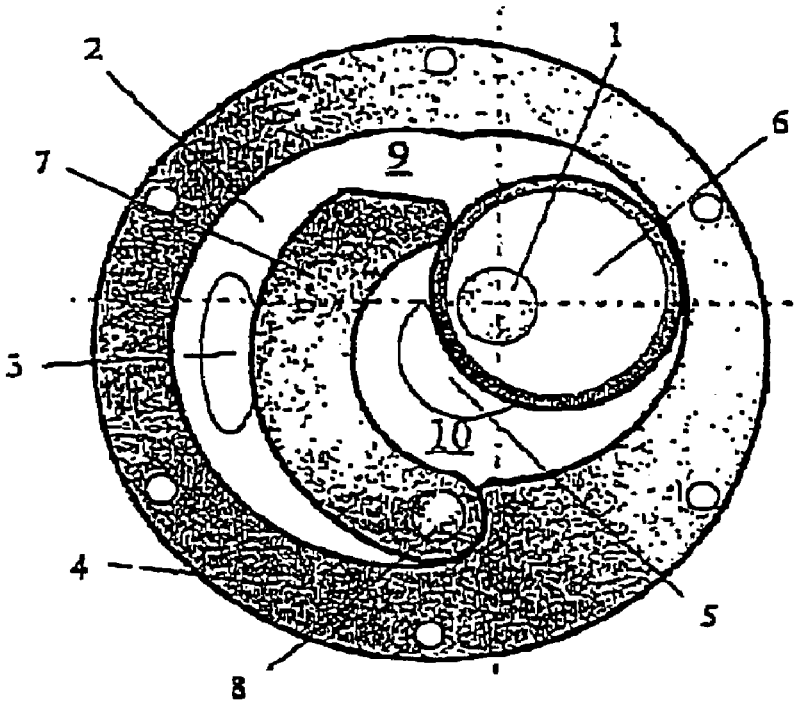
Figure 2:
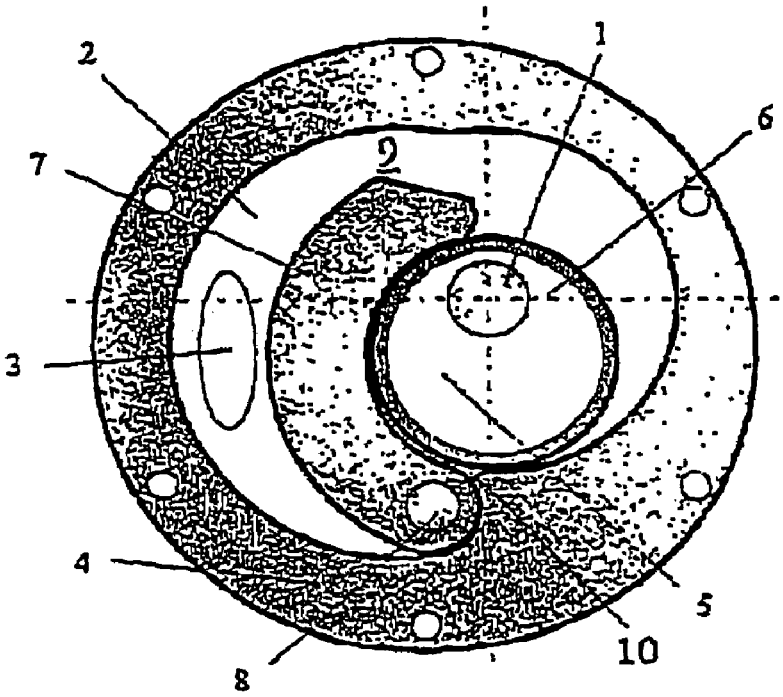
Figure 3:
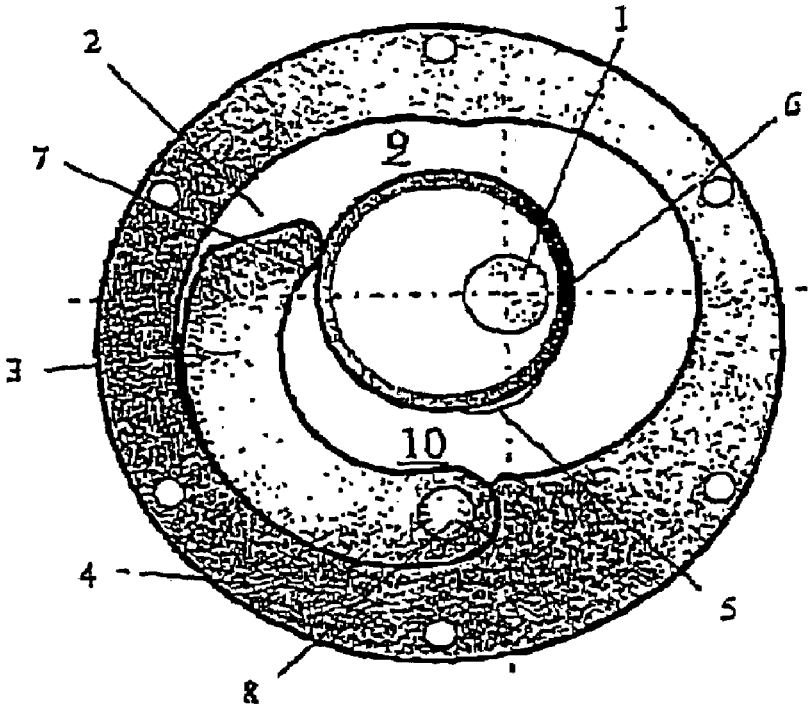

The lever-piston device is in the work stage operating under pressure, when, inside the cylinder 4, the medium under pressure flows in from the inlet opening 3 to act on the lever piston 7 about pivot 8 and the rotating piston 6. The medium that has created pressure during the previous work stage exhausts from the exhaust chamber 10 at a lower pressure, because the outlet opening 5 is open and has reduced the pressure of the medium to discharge. Because the pressure in the work chamber 9 is greater than in the exhaust chamber 10, the pistons 6 and 7 rotate and rotate the shaft 1 clockwise.

FIG. 2

Figure 4:
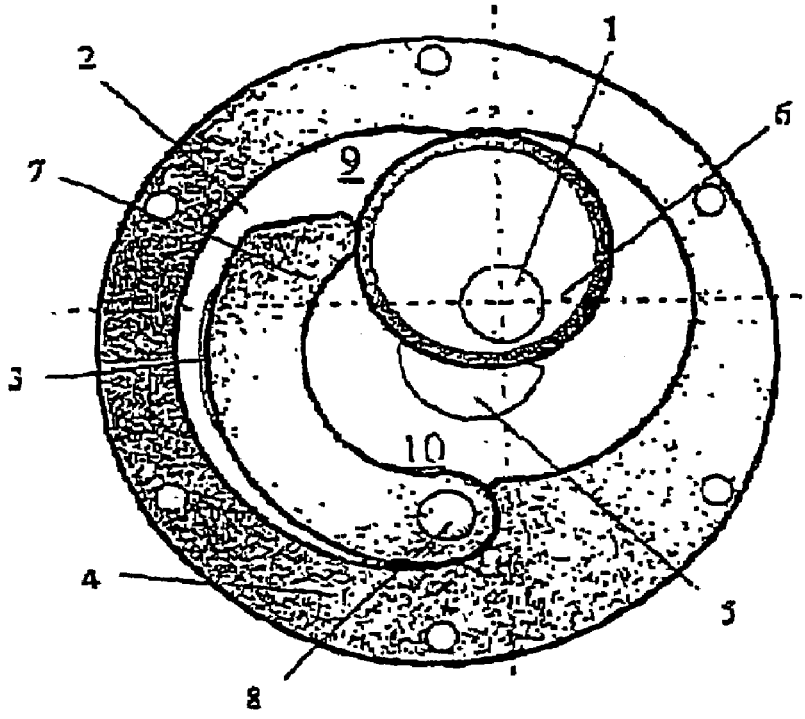

The work stage created by the pressure of the medium of the lever-piston device has ended and the pressure is now equal in both the work chamber 9 and the exhaust chamber 10. The rotating piston 6 is both hollow and eccentric and when it has passed its lower dead centre, buoyancy begins to turn both the rotating piston 6 and the shaft 1 clockwise. The inlet opening for the medium 3 in the head 2 is still open, but, as the pressure surrounding the pistons 6 and 7 and the volume of the cylinder 4 remain unchanged, the buoyancy acting of the rotating piston 6 can turn the shaft 1 clockwise unobstructedly. Due to the buoyancy, the work stage in the device continues until the next work stage created by the pressure in FIG. 4.

FIG. 3

Due to buoyancy, the rotating piston 6 has turned and simultaneously turned the lever piston 7 into a position in which the inlet opening 3 has closed and simultaneously the exhaust opening 5 opened, while the pressure of the work chamber 10 discharges through the exhaust opening 5. The medium does not, however leave the cylinder 4, because the inlet opening 3 is closed and the buoyancy continues to rotate the rotating piston 6 and the shaft 1 clockwise.

FIG. 4

Due to buoyancy, the rotating piston 6 has turned and simultaneously turned the lever piston 7 into a position, in which the medium inlet opening 3 is beginning to open and, because the rotating piston 6 closes the connection between the work chamber 9 and the exhaust chamber 10, the pressure increases in the work chamber, thus starting a new work stage created by the pressure of the medium as the effect of the buoyancy is ending.

The work stages operating by the pressure of the medium and by buoyancy are partly simultaneous at the upper and lower dead centres of the rotating piston and alternate in such a way that there is always a work stage operating in the device.

It is obvious, that the lighter the rotating piston 6 is, the greater is the addition to the efficiency of the operation of the device according to the invention. However, many variations relating to the lightness/hollowness are possible. As previously stated, the invention can also be utilized in connection with other devices of a similar type.

The invention claimed is:

1. A method for increasing power output in a device, the method comprising providing a cylinder, inside of which is a lever piston pivoted to make a reciprocating motion and a rotating piston mounted eccentrically on a shaft to make a complete rotating motion while engaging the lever piston, and the rotating piston being hollow or manufactured from a material lighter than a pressurized liquid medium used in the device, and the cylinder also including an inlet opening leading into a work chamber of the cylinder for opening and closing of the inlet opening by the lever piston and an exhaust opening leading out of an exhaust chamber of the cylinder for opening and closing of the outlet opening by the rotating piston, introducing the pressurized liquid medium into the cylinder during an operating cycle, at least at a lower dead center position of the rotating piston, and moving the rotating piston by a buoyancy of the pressurized liquid medium to move the rotating piston essentially to at least an upper dead center position of the rotating piston.

2. The method according to claim 1, wherein the lever piston is hollow or manufactured from a material that is lighter than the pressurized liquid medium used.

3. The method according to claim 1, wherein work stages operate by the pressure of the liquid medium and by buoyancy at least partly simultaneously in vicinities of the upper and lower dead center positions of the rotating piston and alternating so that a work stage is always taking place in the device.

4. The method according to claim 1, wherein invariableness of the pressure surrounding the rotating piston and the lever piston and of a volume of the cylinder are ensured during a work stage created by the buoyancy of the rotating piston in such a way that the buoyancy acting on the rotating piston turns the shaft.

5. The method according to claim 1, wherein the inlet opening of the cylinder and the exhaust opening of the cylinder are in an area in which the lever piston and correspondingly the rotating piston perform opening and closing, respectively.

6. The method according to claim 1, wherein an effective surface area of the device and a volume of the rotating piston are large in comparison to a volume of the liquid medium used.

* * * * *

UNITED STATES PATENT AND TRADEMARK OFFICE

CERTIFICATE OF CORRECTION

PATENT NO. : 7,600,501 B2
APPLICATION NO. : 11/446526
DATED : October 13, 2009
INVENTOR(S) : Velkko Kalevi Rantala It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 125 days.

Signed and Sealed this

Fifth Day of October, 2010

David J. Kappos

David J. Kappos
*Director of the United States Patent and Trademark Office*